US007658656B2

(12) United States Patent
Hsu et al.

(10) Patent No.: US 7,658,656 B2
(45) Date of Patent: Feb. 9, 2010

(54) SPRING BIASED BLADE CONTACT

(75) Inventors: Hsiu-Yuan Hsu, Tu-cheng (TW); Hung-Yang Yeh, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/069,232

(22) Filed: Feb. 7, 2008

(65) Prior Publication Data

US 2008/0194123 A1 Aug. 14, 2008

(30) Foreign Application Priority Data

Feb. 8, 2007 (CN) ..... 2007 2 0034629 U

(51) Int. Cl.
*H01R 13/24* (2006.01)

(52) U.S. Cl. ..... 439/824; 439/700; 324/754

(58) Field of Classification Search ..... 439/824, 439/700, 319, 513, 66; 324/761, 754
See application file for complete search history.

(56) References Cited

U.S. PATENT DOCUMENTS 4,263,547 A * 4/1981 Johnson ..... 324/72.5
5,685,725 A 11/1997 Kazumi
5,727,954 A 3/1998 Yuji
6,652,326 B2 * 11/2003 Boyle et al. ..... 439/700
6,821,131 B2 * 11/2004 Suzuki et al. ..... 439/73
6,861,862 B1 * 3/2005 Tate ..... 324/761
7,025,602 B1 4/2006 Dong
2008/0003888 A1 * 1/2008 Xu ..... 439/700
2008/0146083 A1 * 6/2008 Hsiao et al. ..... 439/626

* cited by examiner

*Primary Examiner*—Edwin A. Leon
*Assistant Examiner*—Vanessa Girardi
(74) *Attorney, Agent, or Firm*—Andrew C. Cheng; Wei Te Chung; Ming Chieh Chang

(57) ABSTRACT

A contact includes a first contact pin (21) of a blade shape, a second contact pin (22) and a spring (23). The second contact pin includes a connecting portion (223) and a receiving portion (222) opposite to the connecting portion. The receiving portion defines a receiving space (224) to accommodate the first contact pin. The spring locates in the receiving space and allow the first contact pin to shift downwards and upwards therein.

7 Claims, 5 Drawing Sheets

SPRING BIASED BLADE CONTACT

BACKGROUND OF THE INVENTION

1. Field of the Invention

The present invention relates generally to a contact for electronic devices, and more particularly to a contact for electronic devices which electrically connects a plurality of leads of an integrated circuit (IC) provided in a test socket to corresponding pads of a printed circuit board (PCB).

2. Description of Related Art

Conventional contacts of two types are disclosed in U.S. Pat. No. 7,025,602, which is issued to Dong Weon Hwang on Apr. 11, 2006. The first type as shown in FIG. 4 of U.S. Pat. No. 7,025,602, includes a pipe body, an upper and lower contact pins and a spring. The upper and lower contact pins are received in the pipe body with their one ends respectively, and the opposite ends project out the pipe body respectively. The spring locates between said one ends and allow the upper contact pin to shift upwards and downwards. The upper and lower contact pins are of cylindrical shape, which is not easy in manufacture.

The second type of the convention contacts includes a blade-shaped upper and lower contact pins and a spring connecting said two contact pins, which all are received a hole defined in a test socket where the contact are arranged. The spring allows the upper contact pin to shift upward and downward relative to the lower contact pin. However, since the two contact pins are crossedly assembled, the two contact pin must be fabricated accurately, which is not easily obtained in manufacture.

Therefore, an improved contact is desired to overcome the disadvantages of the prior arts.

SUMMARY OF THE INVENTION

An object of the present invention is to provide a contact for electronic device, which is easily produced.

In order to achieve above-mentioned object, a contact comprises a first contact pin of blade shape, a second contact pin and a spring; the second contact pin comprises a connecting portion and a receiving portion opposite to the connecting portion; the receiving portion defines a receiving space to accommodate the first contact pin; the spring locates in the receiving space and allow the first contact pin to shift downwards and upwards therein.

Other objects, advantages and novel features of the present invention will become more apparent from the following detailed description of the present embodiment when taken in conjunction with the accompanying drawings.

DETAILED DESCRIPTION OF THE INVENTION

Figure 1:
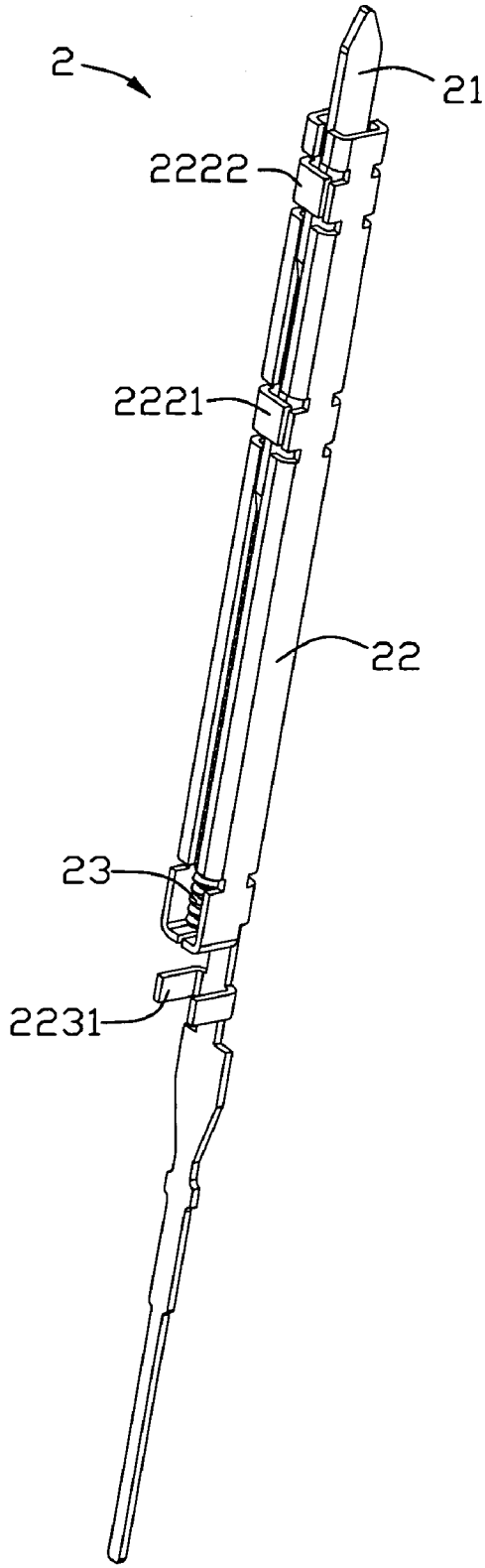
FIG. 1 is a perspective view of a contact in accordance with the present invention.

Reference will now be made to the drawing figures to describe a preferred embodiment of the present invention in detail.

Figure 2:
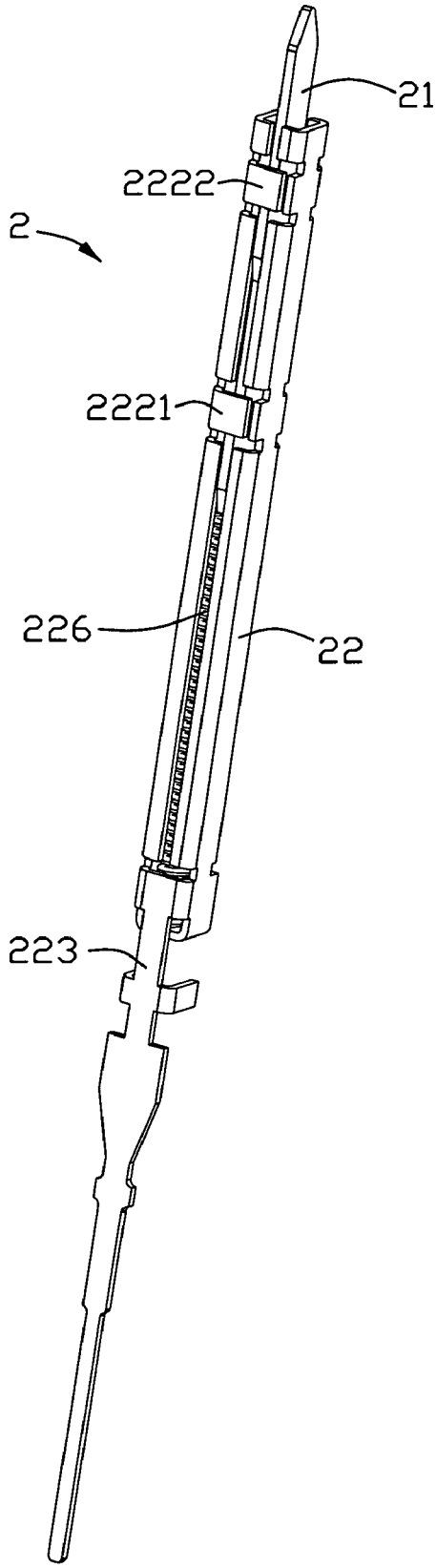
FIG. 2 is another perspective view of the contact.

Referring to FIGS. 1 and 2, a contact in accordance with the present invention is adapted for being arranged in a test socket or a burn-in socket for receiving an IC and electrical connecting the IC to a PCB next. In such a state, the test socket performs the test of the IC.

Figure 3:
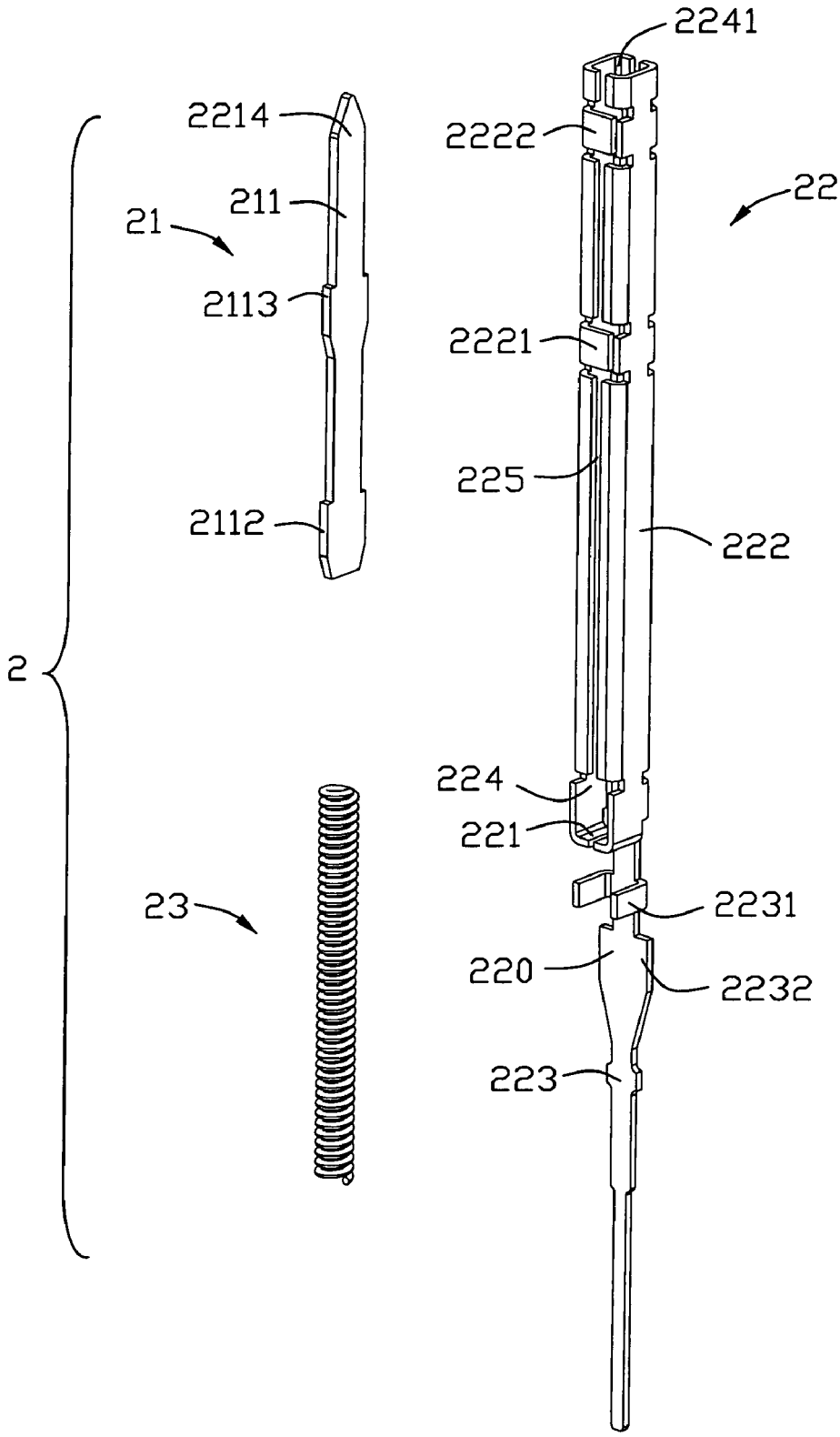
FIG. 3 is an exploded perspective view of the contact.

Referring to FIG. 3, the contact 2 includes a first or upper contact pin 21, a second or lower contact pin 22 and a coin spring 23. The first contact pin 21 is produced by fabricating an elongated sheet metal and includes an elongated base portion 211 with a sharp top end 2214 for contacting with the IC. A first projecting portion 2112 is defined at each lateral side, adjacent a bottom end of the base portion 211. Similarly, a second projecting portion 2113 is defined at each lateral side, adjacent the middle portion of the base portion 211. The blade of first contact pin is easily manufacture.

The second contact pin 22 is produced by fabricating an elongated sheet metal and includes a base portion 220. A connecting portion 223 extends downwards from the base portion 220 to be soldered with the PCB. A receiving portion 222 of box or the like is defined under the base portion 220. A widen metal sheet is extending upward from the base portion 220 and then bents transversely two time to form a rectangular receiving cavity 224 with an upward opening 2241, namely said receiving portion 222. The bottom portion of the side walls of the receiving space 224 bent inward to define a bottom side 221. Two parallel side walls, parallel to the base portion 220 of the receiving portion defines a slot 225, 226 (see FIG. 2) respectively along an extending direction of the receiving space. Two pairs of stopping portions 2221, 2222 separates from other portion of said side walls and divides the slots. A pair of bending portion 2231 bends from the lateral sides of the base portion 220 adjacent to the bottom side 221, and the base portion are widen partly, namely widen portion 2232, both for securing retaining the contacts in the test socket where the contacts are arranged.

Figure 4:
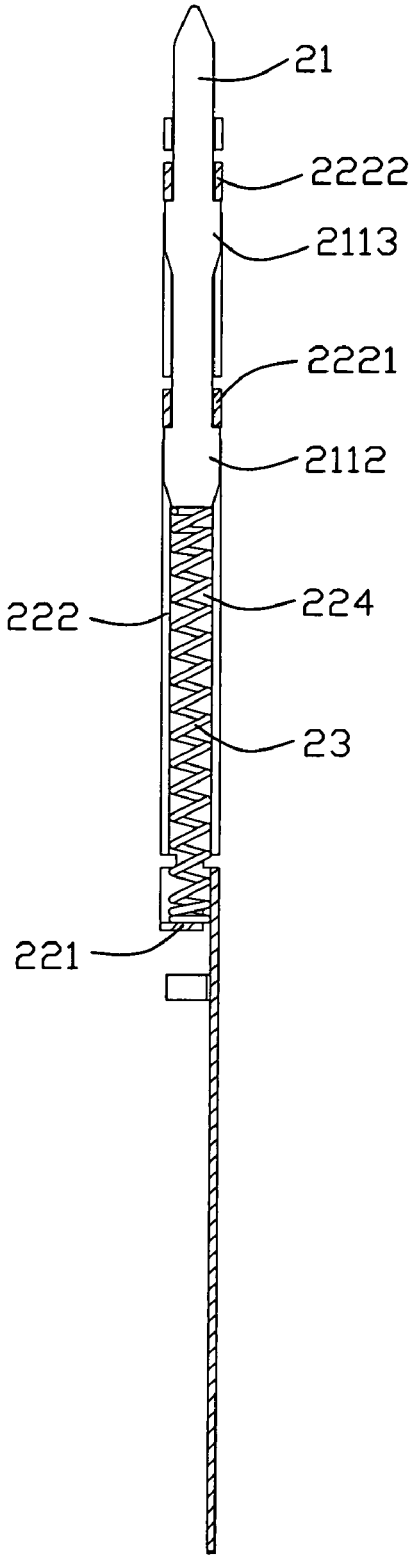
FIG. 4 is a schematic view of contact in a release position wherein the first contact pin is not pressed.
Figure 5:
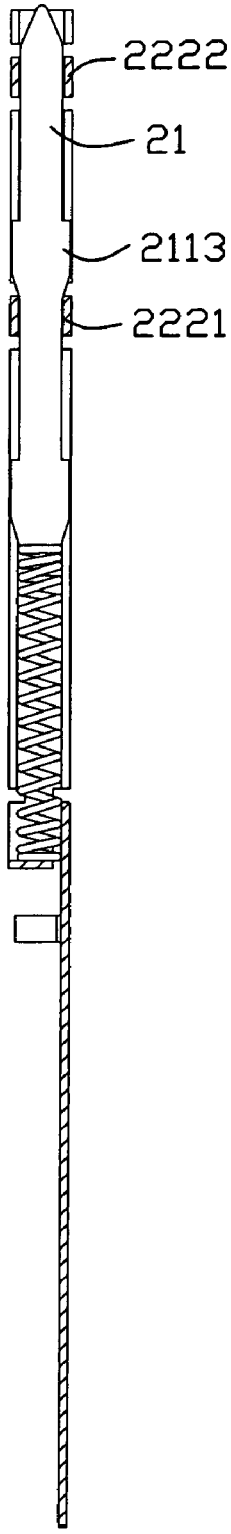
FIG. 5 is a schematic view of contact in a pressed position wherein the first contact pin is pressed downwards.

Seeing FIGS. 4 and 5, the spring 23 is received in the receiving space 224 and supported by the bottom side 221. The first contact pin 21 is also in the receiving space and over the spring 23, of which the projecting portion 2112,2113 is shifting along the slots. In a release position wherein the first contact pin 21 is not be pressed as shown in FIG. 4, the first projecting portions 2112 of the first contact pin 21 are under the first stopping portions 2221 of the second contact pin, and the second projecting portions 2113 are under the second stopping portions 2222 of the second contact pin so that the first contact pin is limited in the second contact pin. In a pressed position wherein the first contact pin 21 is pressed downwards by IC's downward-press as shown in FIG. 5, the second projecting portions 2113 of the first contact pin 21 shift downward until stopped by the first stopping portions 2221.

However, the disclosure is illustrative only, changes may be made in detail, especially in matter of shape, size, and arrangement of parts within the principles of the invention.

What is claimed is:

1. A contact comprising:

a first contact pin of a blade shape;

a second contact pin comprising a connecting portion and a receiving portion opposite to the connecting portion, the receiving portion defining a receiving space to accommodate the first contact pin;

a spring locating in the receiving space and allowing the first contact pin to shift downwards and upwards therein;

wherein the receiving portion defines slots along an extending direction thereof, the first contact pin defines two pairs of projecting portions at opposite lateral sides separately so as to shift in the slots.

2. The contact as described in claim 1, wherein the receiving portion defined two pairs of stopping portions in the slots, the projecting portions is under the stopping portions to prevent upward-release of the first contact pin.

3. The contact as described in claim 1, wherein the receiving space is opened upward.

4. The contact as described in claim 3, wherein the receiving portion has four side walls to define the receiving space of an rectangular shape.

5. The contact as described in claim 4, wherein a pair of side walls bent inward to define a bottom side of the receiving space.

6. A contact comprising:

a first contact pin of a blade shape;

a second contact pin comprising a connecting portion and a receiving portion opposite to the connecting portion, the receiving portion defining a receiving space to accommodate the first contact pin;

a spring locating in the receiving space and allowing the first contact pin to shift downwards and upwards therein;

wherein the second contact pin further comprising a base portion connecting the receiving portion and the connecting portion, the base portion widen partly;

wherein the base portion defines a pair of bending portions perpendicularly to the base portion.

7. An electrical contact comprising:

a tubular piece including a connection portion for mounting to a printed circuit board;

a blade piece received in the tubular piece with a mating portion for mating with a complementary part; and a spring retained to the tubular piece to constantly urge the blade piece away from the tubular piece so as to expose the mating portion to the complementary part; wherein a guiding device is provided between the blade piece and the tubular piece so as to assure no rotation therebetween but only allow up-and-down movement of the blade piece with regard to the tubular piece along an axial direction thereof; wherein said connection portion and the mating portion are essentially located two opposite ends of the contact in said axial direction, respectively;

wherein said blade piece includes two pair of said protruding edges opposite to each other, and said tubular pieces include two pair of side slits opposite to each other receiving the corresponding two pair of protruding edges, respectively.

* * * * *